US008387314B2

(12) United States Patent
Parshad et al.

(10) Patent No.: US 8,387,314 B2
(45) Date of Patent: Mar. 5, 2013

(54) ELECTRIFIED LOCKABLE DOUBLE SIDED STORAGE CABINET

(75) Inventors: David Parshad, Markham (CA); John R. Edwards, Toronto (CA); Peter Woronecki, Holland Landing (CA)

(73) Assignee: Inscape Corporation, Holland Landing, Ontario (CA)

( * ) Notice: Subject to any disclaimer, the term of this patent is extended or adjusted under 35 U.S.C. 154(b) by 0 days.

(21) Appl. No.: 13/373,058

(22) Filed: Nov. 4, 2011

(65) Prior Publication Data

US 2012/0311937 A1 Dec. 13, 2012

(30) Foreign Application Priority Data

Jun. 10, 2011 (CA) ..... 2742556

(51) Int. Cl.
*E04H 1/12* (2006.01)

(52) U.S. Cl. ..... 52/36.1; 52/36.4; 52/36.5; 52/239

(58) Field of Classification Search ..... 52/36.1, 52/36.4, 36.5, 239; 108/50.01, 50.02; 160/135; 312/139.2, 196, 223.3, 223.6, 245, 246
See application file for complete search history.

(56) References Cited

U.S. PATENT DOCUMENTS 4,535,577 A 8/1985 Tenser
4,685,255 A 8/1987 Kelley
D312,014 S * 11/1990 Friedman ..... D6/509
D334,852 S * 4/1993 Beirise ..... D6/436
5,394,658 A * 3/1995 Schreiner et al. ..... 52/36.1
5,406,760 A * 4/1995 Edwards ..... 52/239
5,487,246 A 1/1996 Hodges et al.
5,530,435 A * 6/1996 Toms et al. ..... 340/9.1
5,544,593 A * 8/1996 Canfield et al. ..... 108/110
5,806,258 A * 9/1998 Miedema et al. ..... 52/220.7
5,913,787 A * 6/1999 Edwards ..... 52/220.7
5,924,781 A * 7/1999 Mitchell ..... 312/245
5,974,742 A * 11/1999 Schreiner et al. ..... 52/36.1
6,158,180 A * 12/2000 Edwards ..... 52/220.7
6,442,909 B2 * 9/2002 Waalkes et al. ..... 52/239
6,466,278 B1 * 10/2002 Harrison et al. ..... 348/836
6,497,075 B1 * 12/2002 Schreiner et al. ..... 52/36.1
D473,517 S * 4/2003 Overthun et al. ..... D13/139.4
6,612,077 B2 * 9/2003 Parshad ..... 52/36.5
D481,558 S * 11/2003 Milligan ..... D6/470
6,735,908 B2 * 5/2004 Edwards ..... 52/36.1
6,820,388 B2 * 11/2004 Newhouse et al. ..... 52/223.7
6,941,716 B2 * 9/2005 Kottman ..... 52/489.1
D553,879 S * 10/2007 Juneau ..... D6/436
D559,585 S * 1/2008 Lara ..... D6/436
7,448,168 B2 * 11/2008 Waalkes et al. ..... 52/27
7,565,772 B2 * 7/2009 Waalkes et al. ..... 52/36.1
8,051,506 B2 * 11/2011 Segal ..... 4/597
(Continued)

*Primary Examiner* — Jeanette E Chapman
*Assistant Examiner* — James Buckle, Jr.
(74) *Attorney, Agent, or Firm* — Riches, McKenzie & Herbert LLP

(57) ABSTRACT

A storage cabinet with two electrified back-to back, separated compartments extending through an office partition with a first compartment open to a first side of the partition and another, second compartment open to a second side of the partition, and with one lockable door on each side of the partition to close the compartment opening on that side. The electrified back to back compartments have a depth less than the side to side depth of the cabinet and, preferably have a cavity intermediate the two compartments via which electrical power is directed to an electrical outlet in each compartment.

15 Claims, 16 Drawing Sheets

U.S. PATENT DOCUMENTS

| | | | | |
|---|---|---|---|---|
| 2002/0029529 | A1* | 3/2002 | Waalkes et al. | 52/36.1 |
| 2004/0083658 | A1* | 5/2004 | Laukuf et al. | 52/36.4 |
| 2004/0093805 | A1* | 5/2004 | Underwood et al. | 52/36.1 |
| 2005/0005527 | A1* | 1/2005 | Metcalf et al. | 52/36.1 |
| 2005/0034378 | A1* | 2/2005 | Underwood et al. | 52/36.1 |
| 2005/0144855 | A1* | 7/2005 | Waalkes et al. | 52/36.1 |
| 2009/0173016 | A1* | 7/2009 | Metcalf et al. | 52/36.1 |
| 2010/0205868 | A1* | 8/2010 | Williams et al. | 52/36.4 |
| 2011/0197519 | A1* | 8/2011 | Henriott et al. | 52/36.1 |
| 2012/0186164 | A1* | 7/2012 | Pensi | 52/36.1 |

* cited by examiner

ELECTRIFIED LOCKABLE DOUBLE SIDED STORAGE CABINET

SCOPE OF THE INVENTION

This invention relates to storage bins for office wall partitions and, more particularly, to an electrified storage bin configuration for use on both sides of an office wall partition in a modular office furniture system.

BACKGROUND OF THE INVENTION

Office furniture partitions are known which comprise modular partitions joined end-to-end. Each partition typically comprises a rectangular frame with vertical posts and horizontal beams to which cladding such as a plurality of modular covers are removably coupled. Examples of such partitions include U.S. Pat. No. 5,406,760 to Edwards, issued Apr. 11, 1995; U.S. Pat. No. 4,685,255 to Kelley, issued Aug. 11, 1987; U.S. Pat. No. 5,487,246 to Hodges et al, issued Jan. 30, 1996, and U.S. Pat. No. 4,535,577 to Tenser et al, issued Aug. 20, 1985, the disclosures of which are incorporated herein by reference.

Such partitions are known for use with associated office furniture including, for example, hanging cabinets which are hung on the front of the partition. Such hanging cabinets have the disadvantage that they extend a substantial extent in front of the partition and typically require lighting under the cabinet. The cabinet impedes a user's ability to use the workplace and are relatively expensive.

Overhead cabinets have doors which typically hinge outwardly and require additional space and provide interference with use of the cabinet and the workspace. Sliding doors are known to close cabinets, closets and the like in which two sliding doors are provided, however, such double sliding door configurations have the disadvantage that, at all times, at least one of the doors covers half of the opening.

Systems are known to provide private storage compartment to users on both sides of an office partition such as disclosed in the applicant's U.S. Pat. No. 6,735,908 issued May 18, 2004, the disclosure of which is incorporated herein by reference.

The present inventor has appreciated that such previously known systems suffer the disadvantage that they do not provide an arrangement for space efficient convenient lockable storage of personal electronic devices such as cell phones, personal digital assistants pas computers, note-book computers, lap-top computers, and electronic cameras where such devices may be charged while been securely stored against unauthorized removal.

SUMMARY OF THE INVENTION

To at least partially overcome these disadvantages, the present invention provides a storage cabinet with two electrified back-to back, separated compartments extending through an office partition with a first compartment open to a first side of the partition and another, second compartment open to a second side of the partition, and with one lockable door on each side of the partition to close the compartment opening on that side. The electrified back to back compartments have a depth less than the side to side depth of the cabinet and, preferably have a cavity intermediate the two compartments via which electrical power is directed to an electrical outlet in each compartment.

Another object is to provide a lockable electrified individual, private storage compartment to users on both sides of an office partition wherein electronic devices may be engaged with an electrical outlet and securely locked against unauthorized removal.

Accordingly, the present invention in one of its aspects provides a double sided storage cabinet having a first compartment open at a first access opening on a front face of the cabinet and a second compartment open at a second access opening on an opposite rear face of the cabinet, a first door movable between a closed position covering the first access opening and an open position permitting access to the first compartment through the first access opening, a second door movable between a closed position covering the second access opening and an open position permitting access to the second compartment through the second access opening, a first lock to lock the first door in the closed position, a second lock to lock the second door in the closed position, an interior wall of the first compartment spaced from a parallel interior wall of the second compartment so as to form a cavity therebetween between the first compartment and the second compartment, a first electrical outlet provided on the interior wall within the first compartment, a second electrical outlet provided on the interior wall within the second compartment, and an electrical supply bus located within the cavity and providing electrical power to the first outlet and the second outlet.

In another aspect the present invention provides a modular office furniture system comprising:

an upright partition having a first side and a second side, the partition comprising a supporting framework formed of vertically spaced horizontal beams and horizontally spaced vertical posts defining at least one rectangular internal opening therebetween through the framework from one side of the framework to the other side, the partition having cladding on both sides of the framework to cover portions of the framework on each side of the partition, a storage element mounted to the framework within the rectangular opening extending to each side beyond the cladding on that side, the storage element having:

a horizontal top wall, a horizontal bottom wall spaced vertically from the top wall, a vertical first dividing wall extending between the top wall and the bottom wall, a vertical second dividing wall spaced from the first dividing wall away from the first end wall parallel to the first dividing wall, a vertical first partitioning wall spanning between the first dividing wall and the second dividing wall between the top wall and the bottom wall perpendicular to the first dividing wall, a vertical second partitioning wall spanning between the first dividing wall and the second dividing wall between the top wall and the bottom wall perpendicular to the first partitioning wall, the second partitioning wall spaced from the first partitioning wall, a cavity defined intermediate the first partitioning wall and the second partitioning wall between the first dividing wall and second dividing wall, a first storage compartment enclosed on five sides by the top wall, bottom wall, first dividing wall, second dividing wall and first partitioning wall and having a first access opening open on the first side of the partition spanning from the first dividing wall to the second dividing wall between the top wall and the bottom wall, a second storage compartment enclosed on five sides by the top wall, bottom wall, first dividing wall, second dividing wall and second partitioning wall and having a second access opening open on the second side of the partition spanning from the first dividing wall to the second dividing wall between the top wall and the bottom wall, a first door member on the first side of the partition mounted for movement between a first position in which the first door member overlies the first access opening to close the first access opening and a second position in which the first door member does not cover the first access opening to the first storage compartment, a second door member on the second side of the partition mounted for movement between a first position in which the second door member overlies the second access opening to close the second access opening and a second position in which the second door member does not cover the second access opening to the second storage compartment, a first electrical outlet provided on the first partitioning wall within the first storage compartment, a second electrical outlet provided on the second partitioning wall within the second compartment, an electrical supply bus located within the cavity and providing electrical power to the first electrical outlet and the second electrical outlet, a first lock to lock the first door in the first position of the first door, and a second lock to lock the second door in the first position of the second door.

In yet another aspect the present invention provides a modular office furniture system comprising:

an upright partition having a first side and a second side, the partition comprising a supporting framework formed of vertically spaced horizontal beams and horizontally spaced vertical posts defining at least one rectangular internal opening therebetween through the framework from one side of the framework to the other side, the partition having cladding on both sides of the framework to cover portions of the framework on each side of the partition, a storage element mounted to the framework within the rectangular opening extending to each side beyond the cladding on that side, the storage element having:

a horizontal top wall, a horizontal bottom wall spaced vertically from the top wall, a vertical first end wall extending between the top wall and the bottom wall at a first end of the storage element, and a vertical second end wall extending between the top wall and the bottom wall at a second end of the storage element parallel to the first end wall, a vertical first dividing wall intermediate the first end wall and the second end wall parallel to the first end wall, a vertical second dividing wall intermediate the first dividing wall and the second end wall parallel to the first end wall, a vertical first side wall at the second side of the partition spanning from the first end wall to the first dividing wall between the top wall and the bottom wall, a vertical second side wall at the first side of the partition spanning from the second end wall to the second dividing wall between the top wall and the bottom wall, a vertical first partitioning wall spanning between the first dividing wall and the second dividing wall between the top wall and the bottom wall perpendicular to the first end wall, a vertical second partitioning wall spanning between the first dividing wall and the second dividing wall between the top wall and the bottom wall perpendicular to the first partitioning wall, the second partitioning wall spaced from the first partitioning wall, a cavity defined intermediate the first partitioning wall and the second partitioning wall between the first dividing wall and second dividing wall, a first storage compartment enclosed on five sides by the top wall, bottom wall, first dividing wall, second dividing wall and first partitioning wall and having a first access opening open on the first side of the partition spanning from the first dividing wall to the second dividing wall between the top wall and the bottom wall, a second storage compartment enclosed on five sides by the top wall, bottom wall, first dividing wall, second dividing wall and second partitioning wall and having a second access opening open on the second side of the partition spanning from the first dividing wall to the second dividing wall between the top wall and the bottom wall, a third storage compartment enclosed on five sides by the top wall, bottom wall, first end wall, first dividing wall and first side wall and having a third access opening open on the first side of the partition spanning from the first end wall to the first dividing wall between the top wall and the bottom wall, a fourth storage compartment enclosed on five sides by the top wall, bottom wall, second end wall, second dividing wall and second side wall and having a fourth access opening open on the second side of the partition spanning from the second end wall to the second dividing wall between the top wall and the bottom wall, a first door member on the first side of the partition slidably mounted for linear sliding between a first position in which the first door member overlies the first access opening to close the first access opening and does not cover the third access opening to the third storage compartment and a second position in which the first door member overlies the third access opening to close the third access opening and does not cover the first access opening to the first storage compartment, a second door member on the second side of the partition slidably mounted for linear sliding between a first position in which the second door member overlies the second access opening to close the second access opening and does not cover the fourth access opening to the fourth storage compartment and a second position in which the second door member overlies the fourth access opening to close the fourth access opening and does not cover the second access opening to the second storage compartment, a first electrical outlet provided on the first partitioning wall within the first storage compartment, a second electrical outlet provided on the second partitioning wall within the second compartment, an electrical supply bus located within the cavity and providing electrical power to the first electrical outlet and the second electrical outlet, a first lock to lock the first door in the first position of the first door, and a second lock to lock the second door in the first position of the second door.

BRIEF DESCRIPTION OF THE DRAWINGS

Further aspects and advantages of the invention will become apparent having regard to the following description taken together with the accompanying drawings in which.

DETAILED DESCRIPTION OF THE DRAWINGS

Figure 1:
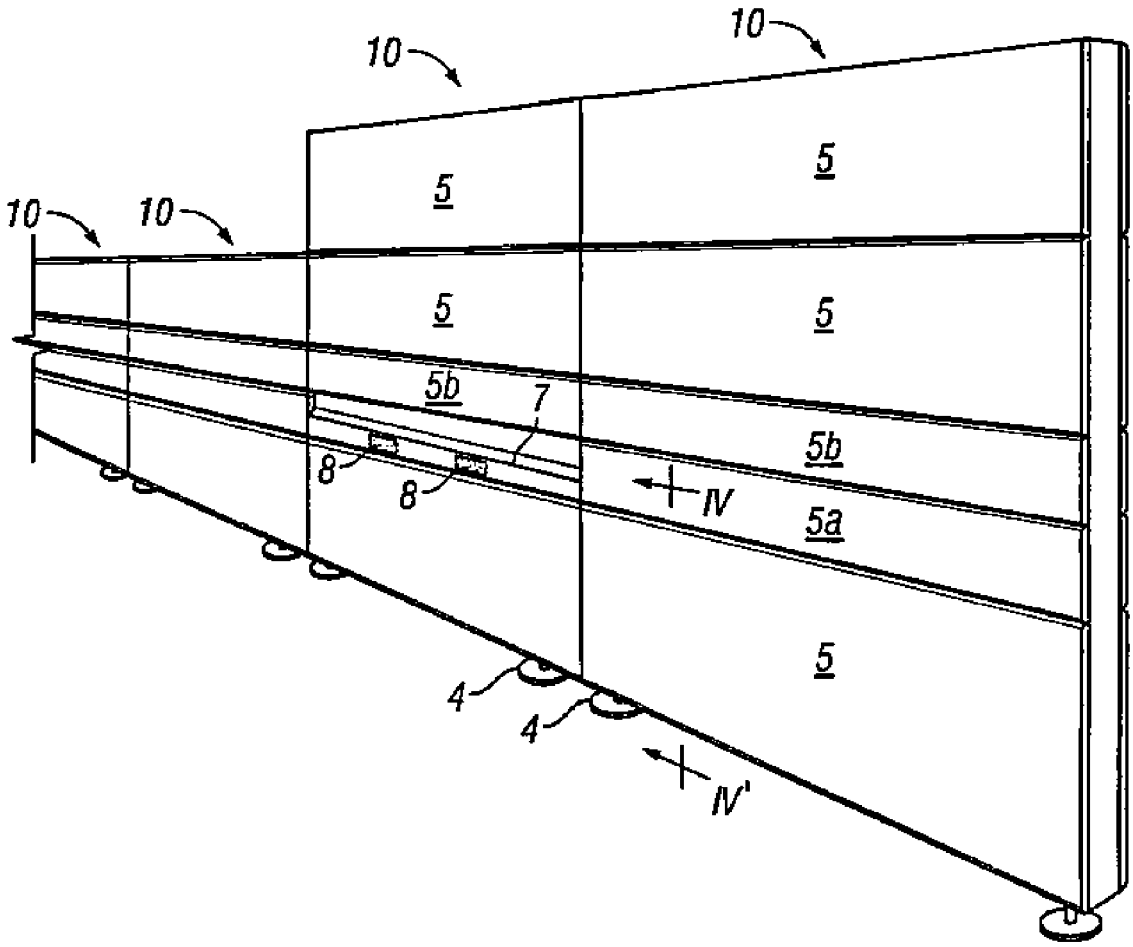
FIG. 1 (PRIOR ART)
FIG. 1 shows a front prospective elevation view of an assembled modular office furniture partition wall including a number of partitions in accordance with U.S. Pat. No. 5,406,760.
Figure 2:
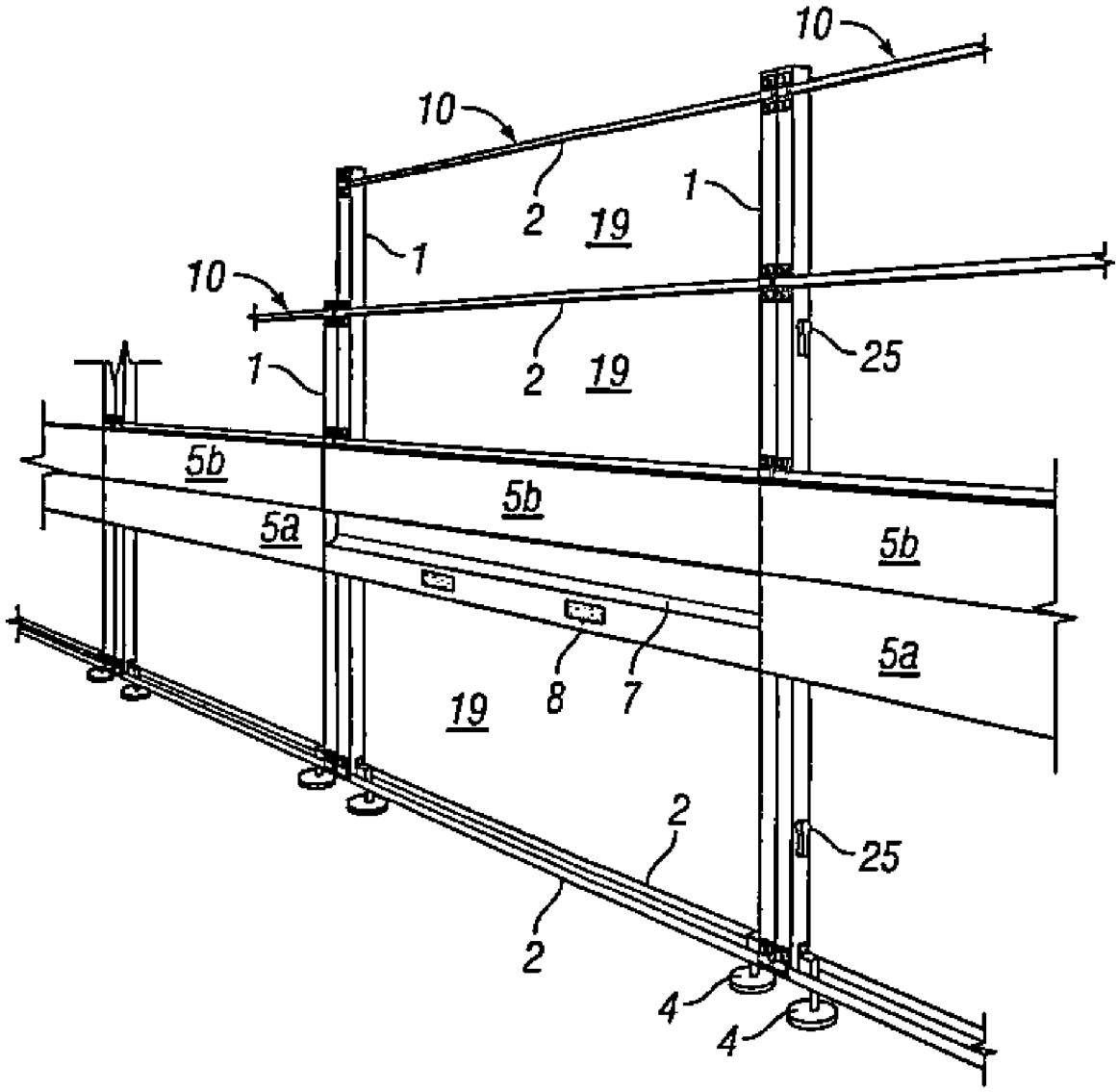
FIG. 2 (PRIOR ART)
FIG. 2 is a frontal prospective view of the partition wall of FIG. 1 with some of the cladding covers removed to reveal the internal partition frames.
Figure 3:
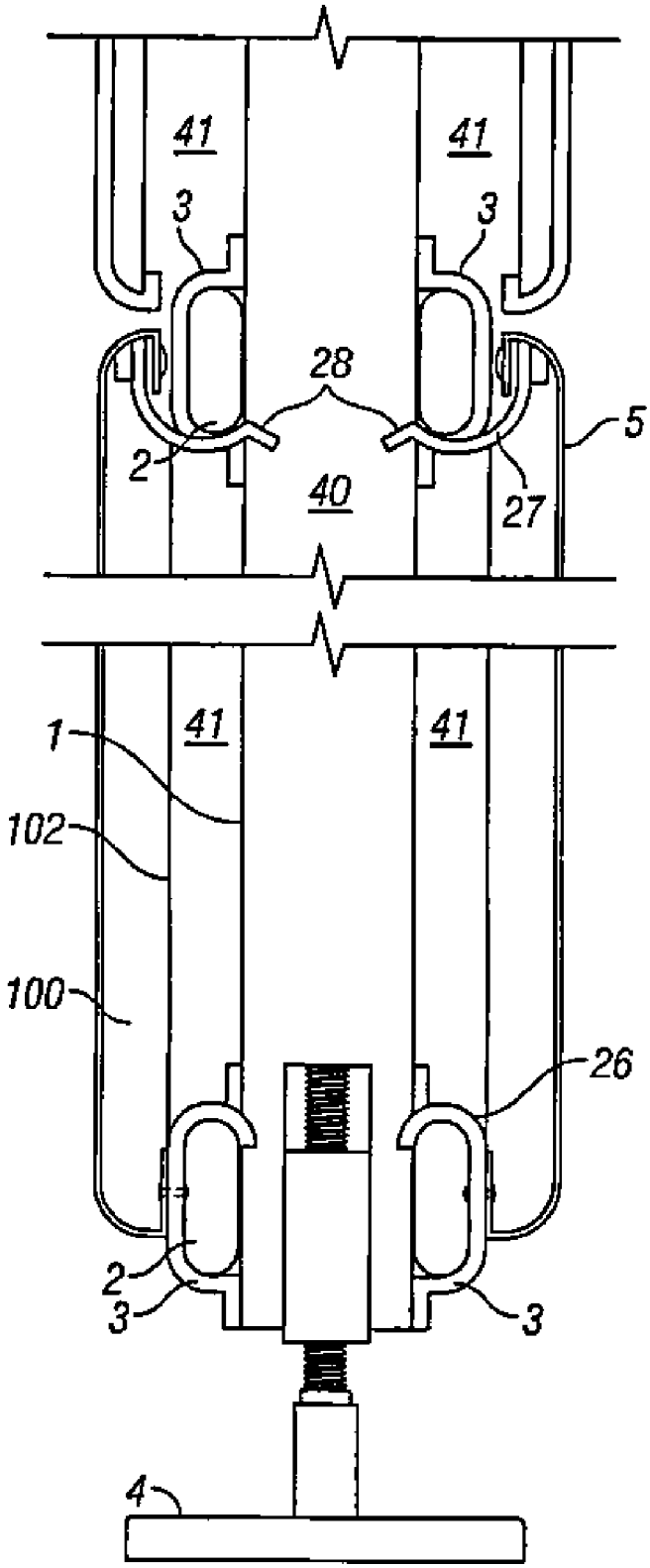
FIG. 3 (PRIOR ART)
FIG. 3 is a schematic pictorial view illustrating a section on a rectangular frame of a partition of the same construction as that shown in FIGS. 1 and 2.

Each of FIGS. 1, 2, 3 and 4 illustrate a panel assembly in accordance with U.S. Pat. No. 5,406,760, the disclosure of which is incorporated herein by reference. The partition wall illustrated comprises a plurality of rectangular partitions generally indicated 10 shown to be arranged end-to-end for convenience. Each partition comprises a generally rectangular frame including vertical frame members or post 1 and horizontal frame members or beams 2. The beams 2 are preferably arranged in parallel pairs on both sides of each post 1. The beams 2 are connected to the outward opposing front and rear faces of each post 1 in an overlapping moment resisting connection. Both the posts 1 and the beams 2 are shown as tubular in cross-section. The post 1 and beams 2 are connected with brackets 3 having a saddle portion of internal profile mating with the external profile of the beams 2. The brackets 3 include flange portions above and below the saddle portion which overlie and are connected to the outward, forward or rearward face of the associated post 1 as by screws, rivets, welding and the like. The posts 1 of adjacent partitions are connected as shown in FIG. 2 in line with the posts 1 of adjacent partitions as by connectors generally indicated as 25.

Figure 4:
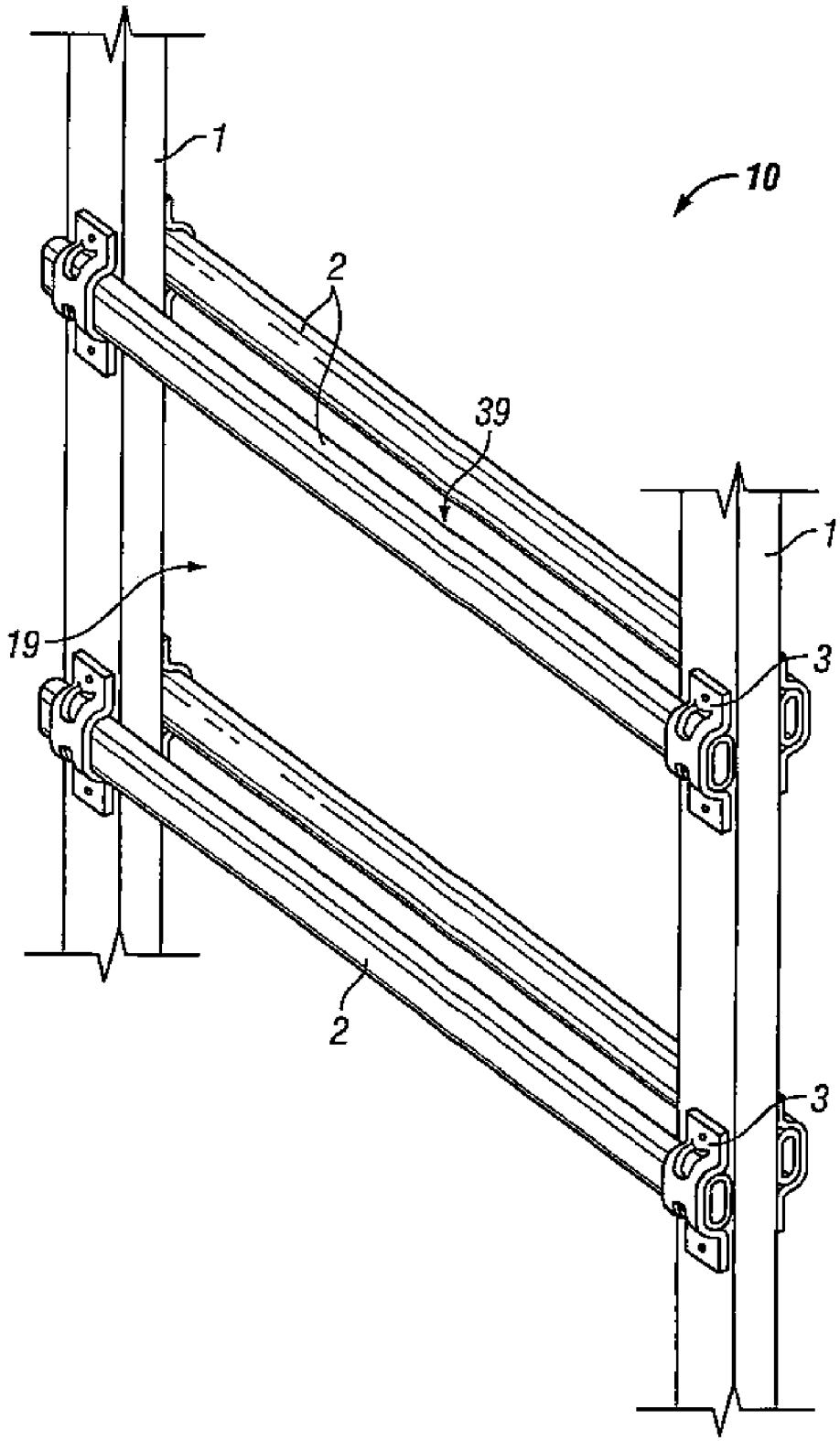
FIG. 4 (PRIOR ART)
FIG. 4 is a cross-sectional end view through a portion of the partition of FIG. 1 along section line 1V-1V' in FIG. 1.

Cladding covers indicated generally as 5 but also specifically as 5*a* or 5*b* are removably coupled to the frame as best seen in FIGS. 2 and 4 laterally outward of the beams 2. As best seen in FIG. 4, due to the thickness of the brackets 3, a vertical space is present between the beams 2 and inward portions of the covers 5 other than where the brackets are present. Mechanisms are provided for mounting the covers 5 to the frame, however, such mounting mechanisms are not illustrated for the purpose of simplicity. The mounting mechanism preferably comprises resilient clips to engage portions of each covers 5 with the clips preferably secured between adjacent beams 2 or to the post 1. Each cover 5 preferably comprises a skin of sheet metal and having at each end a plastic end plug which assists in maintaining the sheet metal in its desired form. The end plug provides a means for engagement of the mounting mechanisms so as to releasably couple each cover 5 to the frame. As shown, each panel 5 preferably spans between adjacent parallel vertically spaced pairs of beams 2, however, in a middle portion of the partitions there are shown covers 5*a* and 5*b* which do not span between adjacent beams 2 but rather are removably coupled to each frame and generally span half the distance between two adjacent beams 2.

The partition illustrated is to be appreciated as formed with an open gridwork of horizontally spaced, vertical posts 1 and vertically spaced, horizontal beams 2 with the result that the partition has a plurality of rectangular internal openings therebetween through the frame from one side to the other and open internal cavities permit the passage of wires and cables therein. The interior cavity is made up of a vertically extending central post space 39 together with horizontally extending raceways 41 adjacent and open to the central post space 39. The central post space 39 is defined between the posts 1, that is, between a forward plane including the forward face of each post 1 and a rearward plane including a rearward face of each post 1. The central post space 39 extends vertically between the spaced, parallel forward and rearward planes and between interior faces of the post 1. The central post space 39 extends continuously vertically throughout the height of the partition open upwardly to above the top of the partition and open downwardly to below the lowest beam of the partition.

A plurality of raceways 41 extend horizontally between the beams 2 outward of the respective of the forward or rearward planes. The raceways 41 extend a full width of each partition and are open at each end to beyond the exterior end faces of the posts. The raceways 41 are defined inward of the covers 5 and extend forwardly and rearwardly from the respective forward and rearward planes the combined thickness of the beams 2 and the saddle portion of the brackets 3.

The raceways 41 are open on their interior sides to the central post space 39 over the entire distance between the posts 1. Whereas the central post space 39 ends at the interior end faces of the post 1, the raceways 41 provide for passageway for conduit horizontally past the posts outward of the posts inward of the covers. Similarly, the central post space 39 provides a passageway for conduit vertically past the beams 2 inward of the beams and inward of the covers. The raceways 41, central post space 39 and covers 5 define an interior cavity in the panel assembly which permits conduit to be routed vertically throughout the partition between the post 1 inside the beams and horizontally across the partition and between adjacent partitions in the raceways outside the post 1 between the beams 2 and inside the covers 5.

As can be seen in FIGS. 2 and 4, a plurality of rectangular internal openings 19 are defined by the posts and beams of the framework extending through the framework from one side of the framework to the other, with such a rectangular opening provided underlying each of the covers 5.

Figure 5:
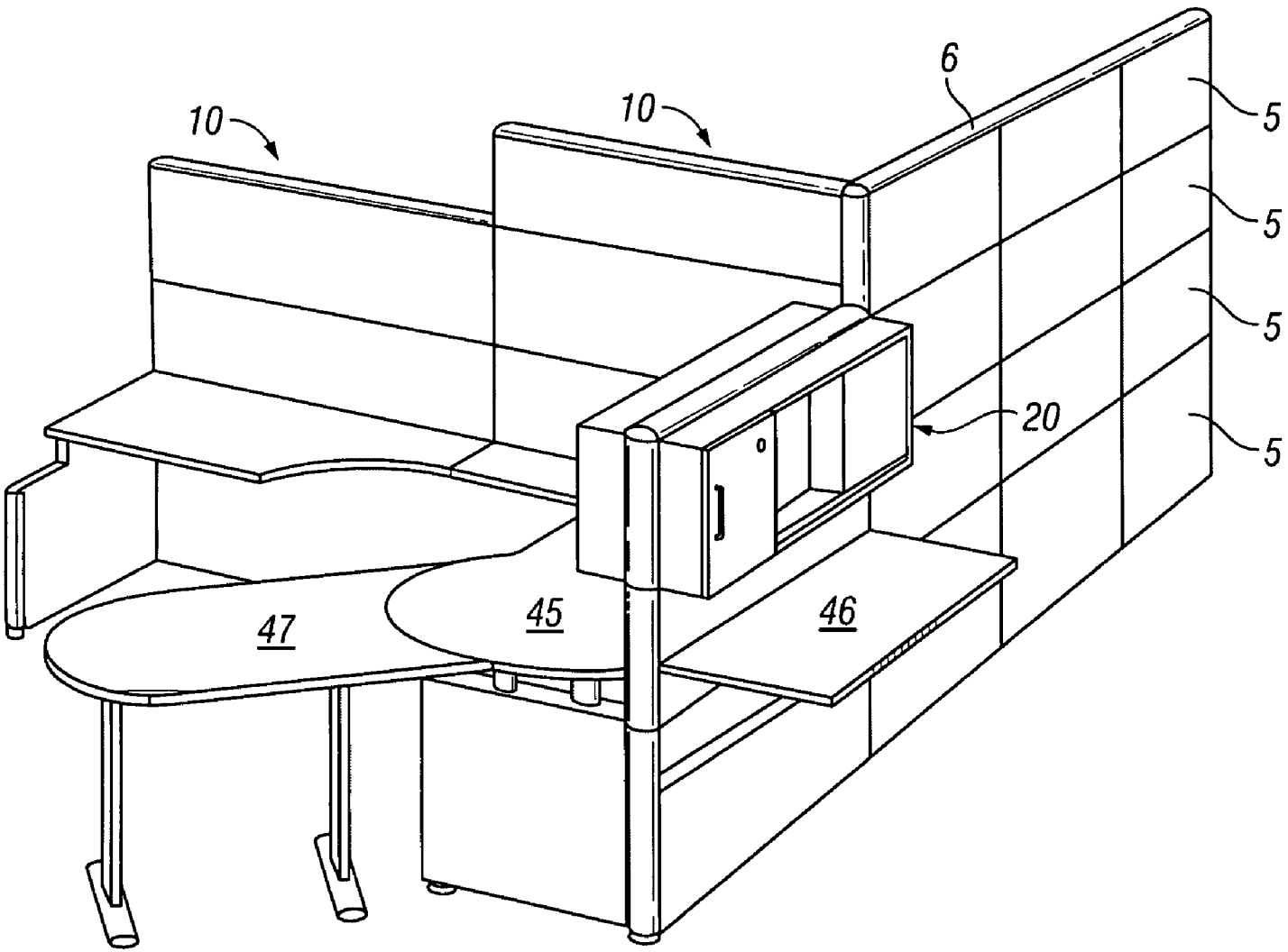
FIG. 5 is a pictorial view of an assembled modular office furniture system utilizing partitions of the type illustrated in FIGS. 1 to 4 and incorporating a straddle bin in accordance with a first embodiment of the present invention as well as desks on either side of a partition forming a wall within the furniture system.

Reference is made to FIG. 5 which shows a storage bin 20 identical to that illustrated in FIGS. 6 to 13 mounted in a modular office furniture system utilizing partitions as described with reference to FIGS. 1 to 4. In FIG. 5 decorative top caps 6 are attached to the tops of the partitions and decorative end caps 49 are attached to ends of some of the partition. FIG. 5 shows a configuration in which a workstation is provided on each side of the partition 10 carrying the straddle bin 20. In this regard, a workstation comprising a desk 45 is provided on one side of the partition 10 carrying the straddle bin 20 and a workstation comprising a desk 46 is provided on the other side of the partition carrying the straddle bin 20. In this configuration, some of the compartments in the straddle bin would be open to the workstation on one side of the partition and other of the compartments in the straddle bin would be open to the workstation on the other side of the partition. Desk arrangements are shown comprising desks 45 and 46 which are attached to and modular with the partitions 10, however, separate desks such as the removable desk indicated as 47 could be provided in substitution for the coupled desks 45 and 46.

Reference is made to FIGS. 6 to 14 which show a first embodiment of a straddle bin 20 in accordance with the present invention.

Figure 6:
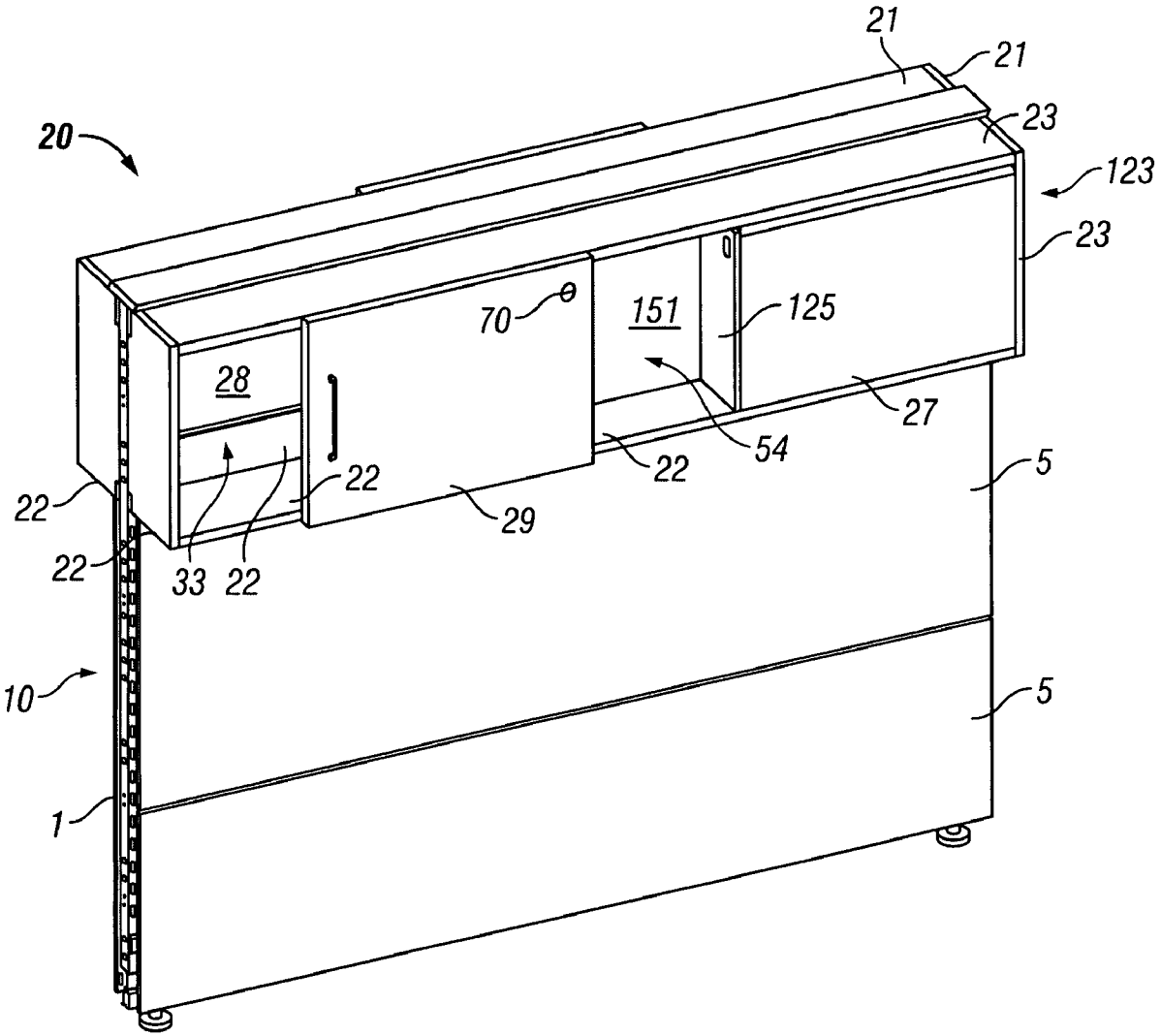
FIG. 6 is a pictorial view of the one partition illustrated in FIG. 5 incorporating a straddle bin with the door in an intermediate position.
Figure 7:
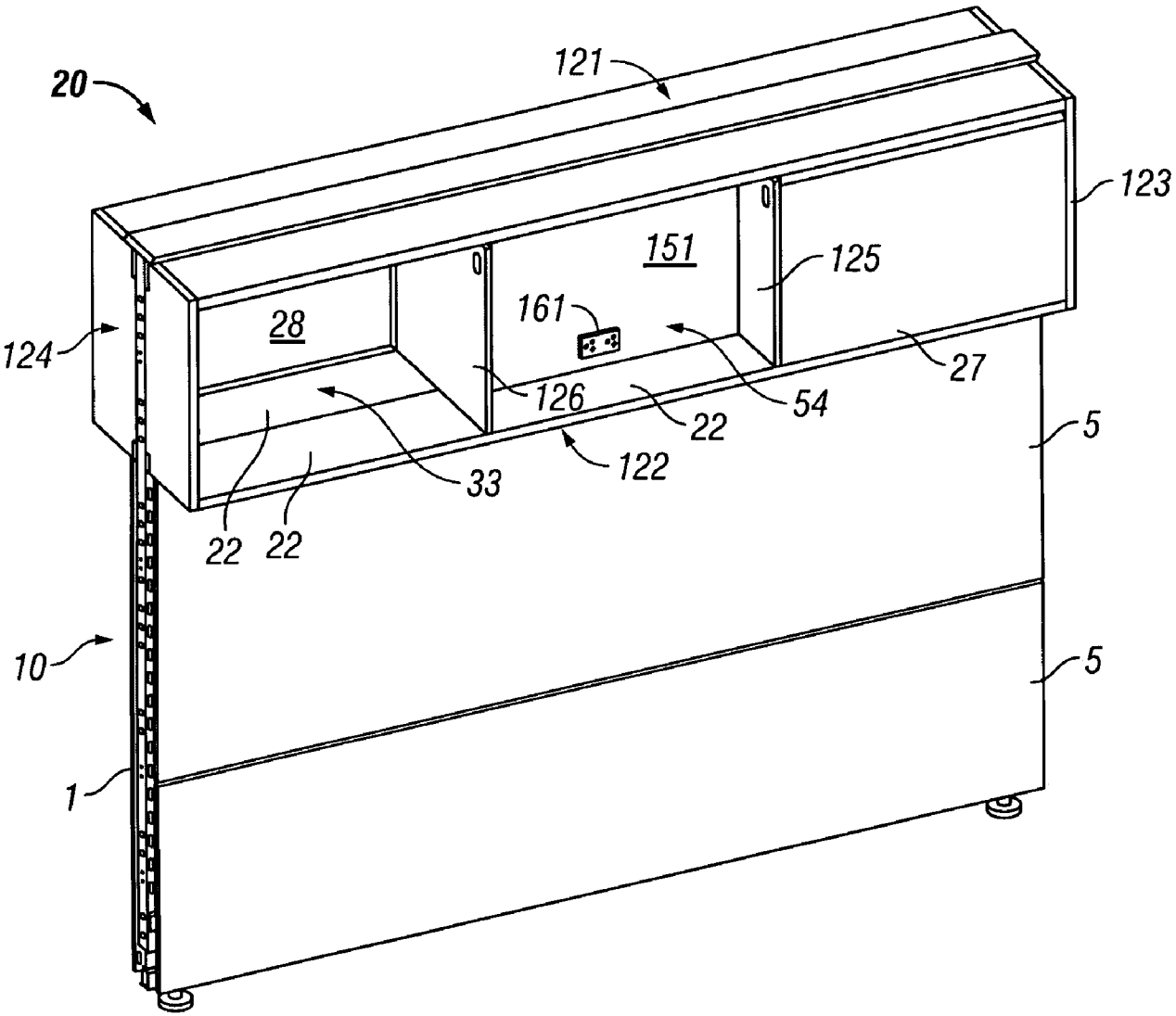
FIG. 7 is a pictorial view the same as FIG. 6 but with the door removed.

In FIG. 6, the partition 10 of the construction illustrated in FIGS. 1 to 4 carrying the straddle bin as shown in FIG. 5 but with the desk 46 not shown for simplicity of illustration. This partition 10 is to be adapted to be covered by three covers 5. The perimeter of each of the covers 5 shown in FIG. 5 overlies at its upper and lower edges, horizontal beams and at its vertical edges, vertical posts. It is to be appreciated that in FIGS. 5 and 6, one cover have been removed from each side of the partition leaving a rectangular internal opening therethrough and within which opening the straddle bin 20 is mounted.

As shown in the drawings and may be understood, particularly from FIGS. 10, 11, 12 and 13, the straddle bin 20 is conceptually formed by a horizontal top wall 121 formed by two horizontal top wall members 21 and a horizontal bottom wall 122 formed by two horizontal bottom wall members 22 spaced vertically from the top wall members 21. The top wall members 21 and the bottom wall members 22 extend parallel to each other transversely through the partition 10.

Two vertical end wall members 23 extend between the top wall members 21 and the bottom wall members 22 at a first end of the straddle bin to form a first end wall 123. Two vertical end wall members 24 extend between the top wall members 21 and the bottom wall members 22 at a second end of the straddle bin to form a second end wall 124. Each of the end members 23 are adapted to be coupled to opposite sides of a post 1 to effectively form with the post the first end wall 123 that extends transversely through the partition at a first end of the partition. Similarly, each of the end wall members 24 is secured to a post 1 to effectively form with the post 1 the second end wall 124 at the second end of the partition parallel to the first end wall 123.

A vertical first dividing wall 125 is provided intermediate the end wall members 23 and the end wall members 24 with the first dividing wall 125 extending parallel to the end wall members 23 and 24.

A vertical second dividing wall 126 is provided intermediate the end wall members 24 and the first dividing wall 125 with the second dividing wall 126 also extending parallel to the end wall members 23 and 24.

The partition 10 for convenience is indicated as having a first face or side 31 and a second face or side 32.

On the first side 31 of the partition, a vertical second side wall member 28 is provided spanning from the second end wall 124 to the second dividing wall 126 between the top wall 121 and the bottom wall 122.

On the second side 32 of the partition, a vertical first side wall member 27 is provided spanning from the first end wall 123 to the first dividing wall member 125 between the top wall 121 and the bottom wall 122.

A vertical first partitioning wall 151 is provided intermediate the top wall 121 and the bottom wall 122 extending between the first dividing wall 125 and the vertical second dividing wall 126 parallel to the vertical first side wall member 27.

A vertical second partitioning wall 152 is provided intermediate the top wall 121 and the bottom wall 122 extending between the first dividing wall 125 and the second dividing wall 126 parallel to the vertical first side wall member 27. The second partitioning wall 152 is spaced towards the second side 32 of the partition from the first partitioning wall 151.

A first storage compartment 54 is defined enclosed on five sides by the top wall 121, bottom wall 122, the first dividing wall 125, the second dividing wall 126 and the first partitioning wall 151. This first storage compartment 54 has a first access opening 55 open on the first side 31 of the partition and spanning from the first dividing wall 125 to the second dividing wall 126 between the top wall 121 and the bottom wall 122.

A second storage compartment 56 is defined enclosed on five sides by the top wall members 21, bottom wall members 22, the first dividing wall 125, the second dividing wall 126 and the second partitioning wall 152. This second storage compartment 56 has a second access opening 57 open on the second side 32 of the partition and spanning from the first dividing wall 125 to the second dividing wall 126 between the top wall 121 and the bottom wall 122.

A cavity 153 is defined between first partitioning wall 151 and the second partitioning wall 152 intermediate the first dividing wall 125 and the second dividing wall 126. The cavity 153 is open vertically to the central post space 39 of the partition and open to the horizontally extending raceways 41 via the central post space 39, as to permit electrical cables and conduit to be passed into and through the cavity 153.

Figure 12:
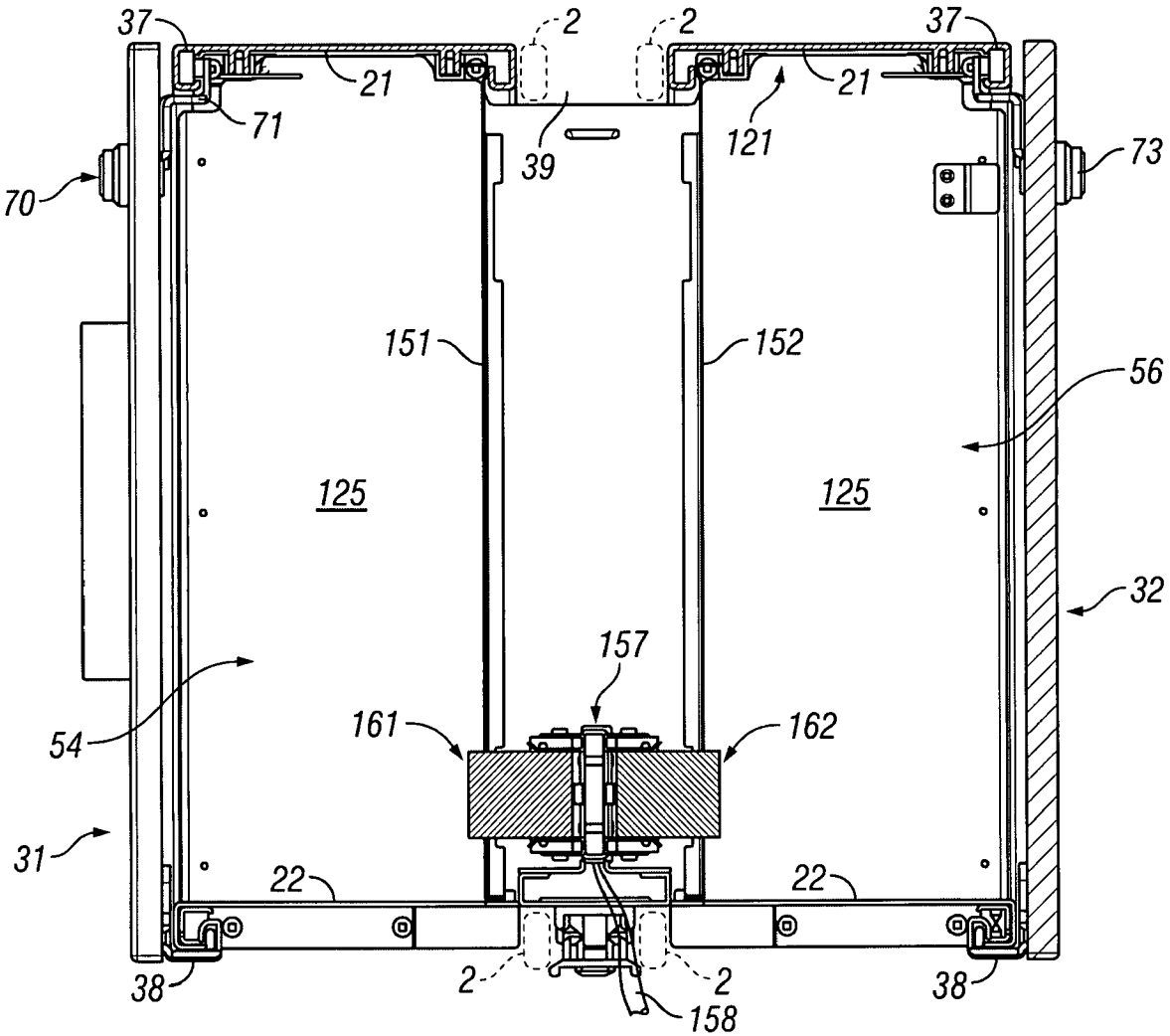
FIG. 12 is an end cross-sectional view along section line B-B' in FIG. 10.
Figure 13:
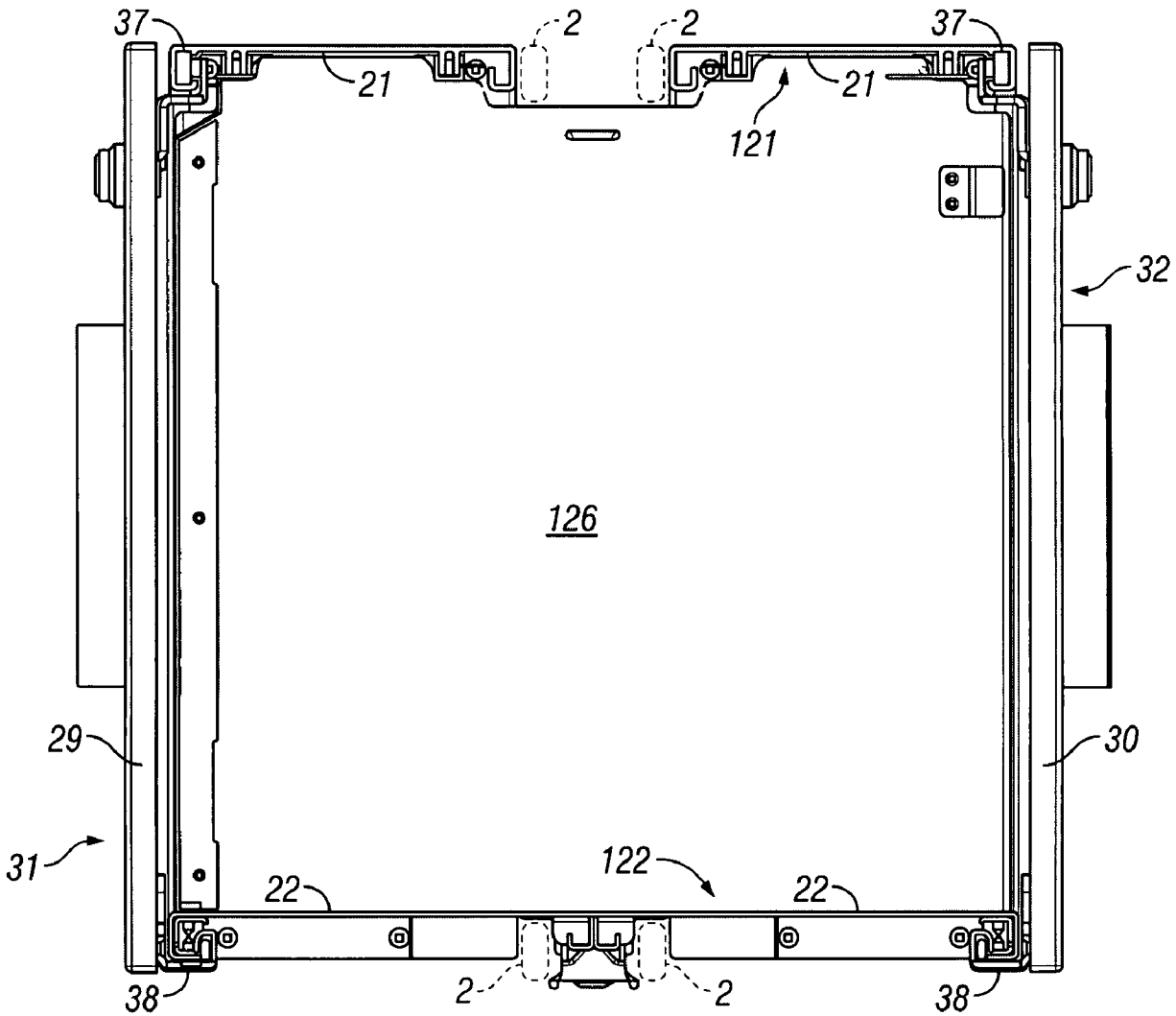
FIG. 13 is an end cross-sectional view along section line C-C' in FIG. 10.

On the cross sectional views of FIGS. 12 and 13, the location of two pairs of the beams 2 are shown in dashed lines. The first partitioning wall 151 is on the first side 31 of these beams proximate thereto and the second partitioning wall 152 is on the second side 32 of these beams proximate thereto forming the cavity 153 therebetween open vertically to the central post space 39 between these beams 2 between the first dividing wall 125 and the second dividing wall 126. An electrical power buss 157 is mounted in the cavity 153 to the lower pair of beams 2. The power buss 157 is connected to an electrical power supply, preferably for 120 volt conventional power as by a supply cable 158 which extends through the central post space. Two electrical outlets, namely a first outlet 161 and a second outlet 162 mounted to each side of the power buss 157 and electrically connected thereto. The first electrical outlet 161 extends through an aperture in the first partitioning wall 151 so as to present the first electrical outlet 161 directed toward the first side 31 into the first compartment 54 and accessible therein. The second electrical outlet 162 extends through an aperture in the second partitioning wall 152 so as to present the second electrical outlet 162 directed toward the first second 32 into the second compartment 56 and accessible therein.

A third storage compartment 33 is defined enclosed on five sides by the top wall 121, bottom wall 122, second end wall 124, second dividing wall 126 and the second side wall member 28. The third storage compartment 33 has a third access opening 35 open on the first side 31 of the partition 10 spanning from the second end wall 124 to the second dividing wall 126 between the top wall members 21 and the bottom wall members 22.

A fourth storage compartment 34 is defined enclosed on five sides by the top wall 121, bottom wall 122, first end wall 123, the first dividing wall 125 and the first side wall member 27. This fourth storage compartment 34 has a fourth access opening 36 open on the second side 32 of the partition and spanning from the first end wall 123 to the first dividing wall 125 between the top wall members 21 and the bottom wall members 22.

The straddle bin 20 thus defines the first and second storage compartments 54 and 56 as two partial depth compartments and the third and fourth storage compartments 33 and 34 as two full depth compartments, each having a blind end and each having an access opening which opens to one side of the partition.

Doors are provided to close the access openings of each compartment. In this regard, as seen in cross sectional side views in FIGS. 12 and 13 proximate each of the first side 31 and the second side 32 a respective pair of an upper track member 37 and a lower track member 38 are provided in the top wall 121 and in the bottom wall 122 respectively.

Figure 8:
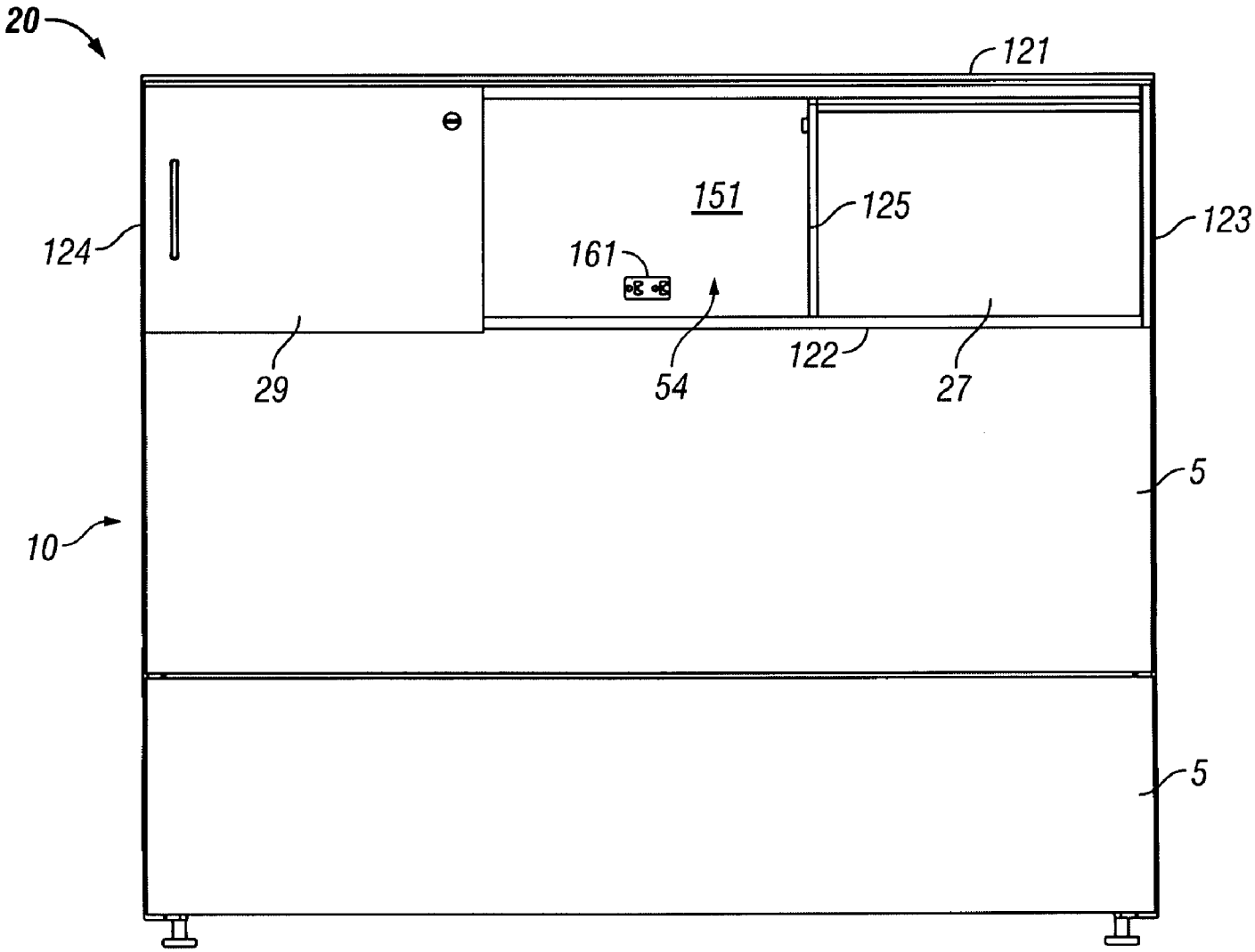
FIG. 8 is a front elevation view of the partition shown in FIG. 6 with the door in a second position.
Figure 9:
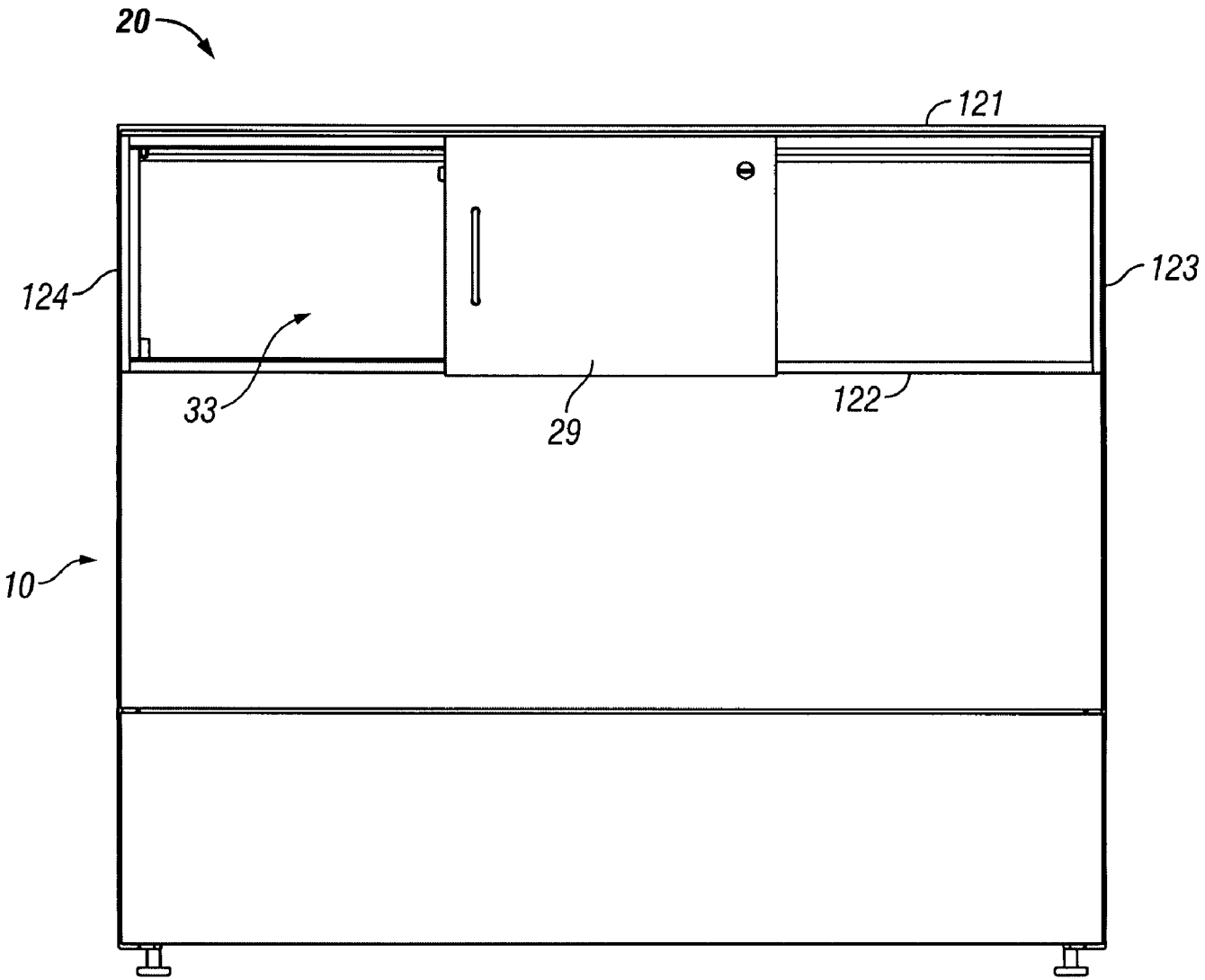
FIG. 9 is a front elevation view of the partition the same as in FIG. 8 but shown in FIG. 6 with the door in a first position.
Figure 10:
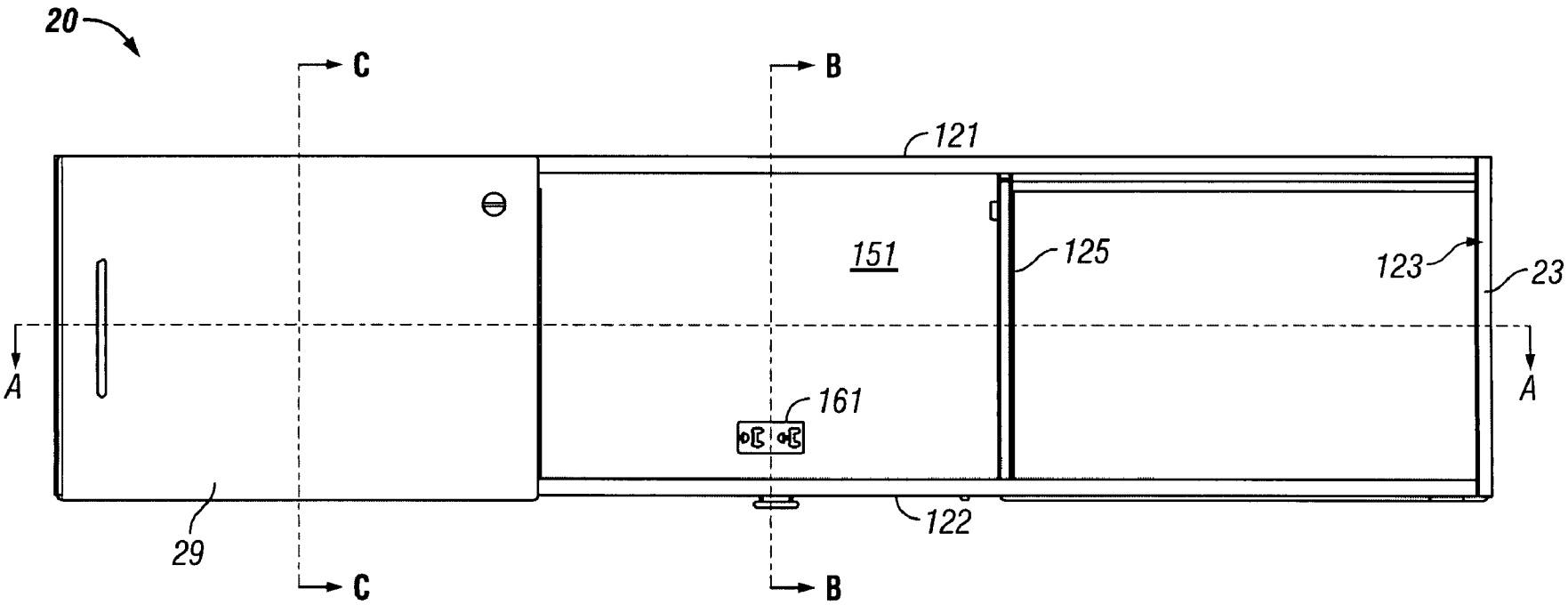
FIG. 10 is an enlarged front elevation view of merely the straddle bin as in FIG. 8.

A first door member 29 is provided on the first side 31 of the partition 10 slidably mounted for linear sliding in the upper track 37 and the lower track 38 laterally outwardly beyond the dividing walls 125 and 126 between: a first position seen in FIG. 9 in which the door member 29 overlies the first access opening 55 to close the first access opening 55 to the first compartment 54 and not cover the third access opening 35, a second position seen in FIG. 8 in which the first door member 29 overlies the third access opening 35 to the third compartment 33 and does not cover the first access opening 55 to the first compartment 54, and a third position in which the first door member 29 overlies the first side wall member 27 and not cover the first access opening 55 or third access opening 35.

Figure 11:
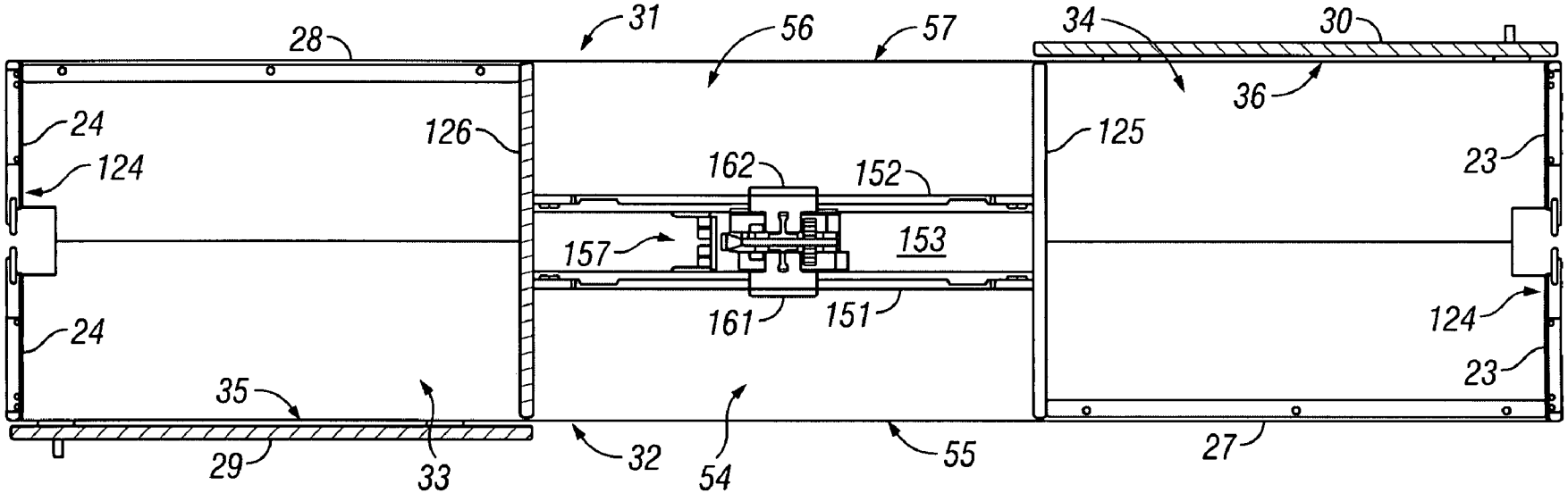
FIG. 11 is a top cross-sectional view along section line A-A' in FIG. 10.

A second door member 30 is provided on the second side 32 of the partition 10 slidably mounted for linear sliding in the upper track 37 and the lower track 38 laterally outwardly beyond the dividing wall members 25 and 26 between: a first position in which the door member 29 overlies the second access opening 57 to close the second access opening 57 to the second compartment 56 and does not cover the fourth access opening 36, a second position as seen in FIG. 11 in which the second door member 30 overlies the fourth access opening 36 to the fourth compartment 34 and does not cover the second access opening 58 to the second compartment 56, and a third position in which the second door member 30 overlies the second side wall member 28 and not cover the second access opening 57 or fourth access opening 36.

Each of the door members 29 and 30 are adapted to be locked at least in their first position in which they respectively overlie and close the first and second access openings 55 and 56. In this regard, as seen in FIG. 6, the first door member 29 is provided with a key activated lock 70 which, as best seen in side view in FIG. 12, carries a rotatable lock pawl 71 which in a locked position engages within a slot within the upper track 37. Preferably, slots are provided such that the first door member 29 may be locked either in the first position to secure the first storage compartment 54 or in the second position to secure the third storage compartment 33. Similarly, the second door member 39 carries a lock 73 adapted for locking the second door member 30 in the first position to secure the second storage compartment 56 and, in the second position, to secure the fourth storage compartment 34. Each of the door members 29 and 30 are shown to be slidable to their third position, however, this is not necessary and in accordance with the invention merely sliding between the first position and the second position need preferably be provided.

Figure 14:
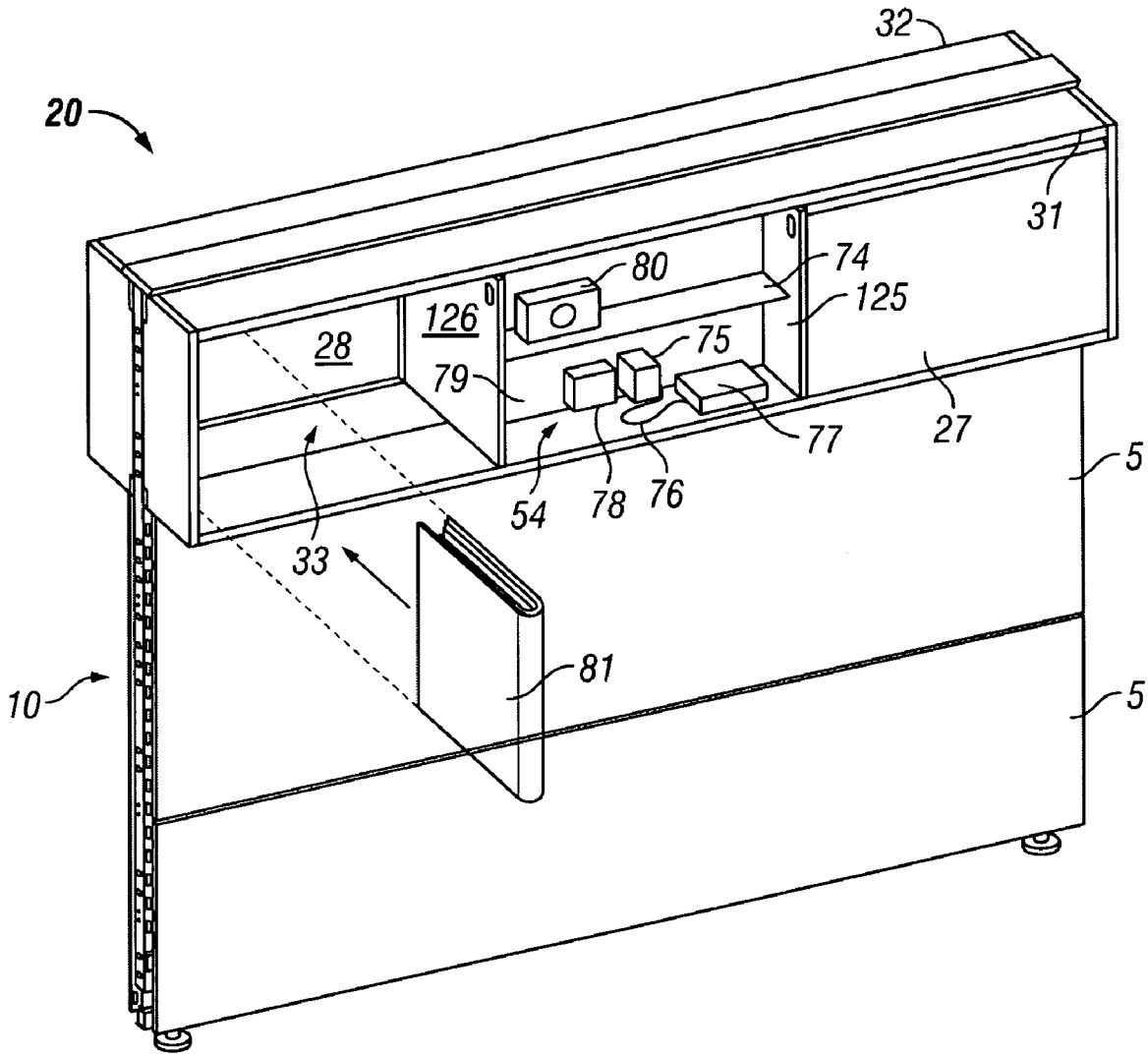
FIG. 14 is a pictorial view the same as FIG. 7, however, schematically illustrating electronic components disposed within the electrified storage compartment.

Reference is made to FIG. 14 in which there is schematically shown within the first storage compartment 54 an optional horizontal shelf 74 which extends between the first dividing wall 125 and the second dividing wall 126, preferably having its ends secured to each of these dividing walls. The shelf 74 preferably has a depth which is less than the depth of the first storage compartment 56. A first charger 75 is schematically shown as coupled to one outlet plug of the electrical outlet in the first storage compartment 54 which first charger 75 is connected in a known manner by a wire 76 which is plugged into a cellular telephone or PDA 77 to charge the same. Similarly, a second charger 78 is shown as plugged into the other outlet plug of the electrical outlet in the first storage compartment 54 with a similar wire 79 extending forwardly of the shelf 74 to be engaged in a camera 80 as schematically shown as being received on the shelf 74. With the cellular telephone 77 and camera 80 so disposed within the first storage compartment 54 and preferably being electrically connected with their chargers for charging, the first door member may be moved to the first position and locked in place so as to securely retain these electronic components within the first storage compartment 54 against unauthorized removal. Where a larger device such as a pad computer such as that sold under the trade mark I-PAD by Apple Computer Inc. or a notebook computer or lab-top computer, the shelf may be eliminated and the device stood up on an end so as to fit within the first storage compartment.

FIG. 14 also schematically illustrates a typical binder 81 for paper such as 8.5" by 11" paper or A4 size paper which is typically used in many environments. Such a binder or a similar book typically has width in the range of about 9 to 12 inches. The third storage compartment 33 advantageously have a depth from the first side wall 28 to the third access opening to accommodate such binders, preferably without any substantial excess depth so as to minimize the extent that the straddle bin 20 protrudes from each side of the partition 10 past the covers 5. In a preferred arrangement with the straddle bin having an overall depth from the first side 31 to the second side 32 in the range of 12 to 15 inches, with each door 29 and 30 occupying a depth of about ½" and with the cavity 153 typically having a depth in the range of about 2" to 4", this provides a depth for each of the first storage compartment 54 and the second storage compartment 56 of about 3" to 6" which is ample for most smaller rechargeable portable electronic devices. Preferably each of the first storage compartment 54 and the second storage compartment 56 will have a depth of at least 3' and preferably no more than 6". Each of the first storage compartment 54 and the second storage compartment 56 preferably has a width and a height approximately the same as the third and fourth storage compartments although this is not necessary. Preferred widths and heights of the first storage compartment 54 and the second storage compartment 56 are at least 12".

The outwardly directed surfaces of the door members and/or the side wall members may serve an additional purpose as preferably comprising a mirror, a whiteboard surface, a blackboard surface, a tack board surface or a magnetic board surface. In this regard, the surfaces could comprise a mirror or have a mirror attached thereto. The surfaces could be used to mount notes as by being a tack board, for example, having a layer of cork secured thereto and to which pins and the like could be stuck or by having a magnetic surface such that magnets could hold notes onto the surface. The surfaces could also be used for carrying markings such as being a whiteboard or blackboard for marking by whiteboard pens or chalk or the like. Similarly, one or more of the surfaces could be provided with a thin frame-like structure so as to serve the purpose as comprising a picture frame within which a photograph or notice or the like could be mounted.

The preferred embodiments illustrated in FIG. 5 show the straddle bin 20 as mounted at a height above a tabletop or desk surface. It is to be appreciated that this is not necessary. Each straddle bin 20 may be mounted at different heights on the partitions 10 including positions above a table top, at a tabletop height or adjacent thereto and below a tabletop.

The preferred embodiment in FIG. 5 illustrates a straddle bin in which the straddle bin extends the width of a partition, that is, from one adjacent post to another post in the partition. It is to be understood that this is not necessary, and a straddle bin 20 may as extending only apportion of the distance between the posts.

Figure 15:
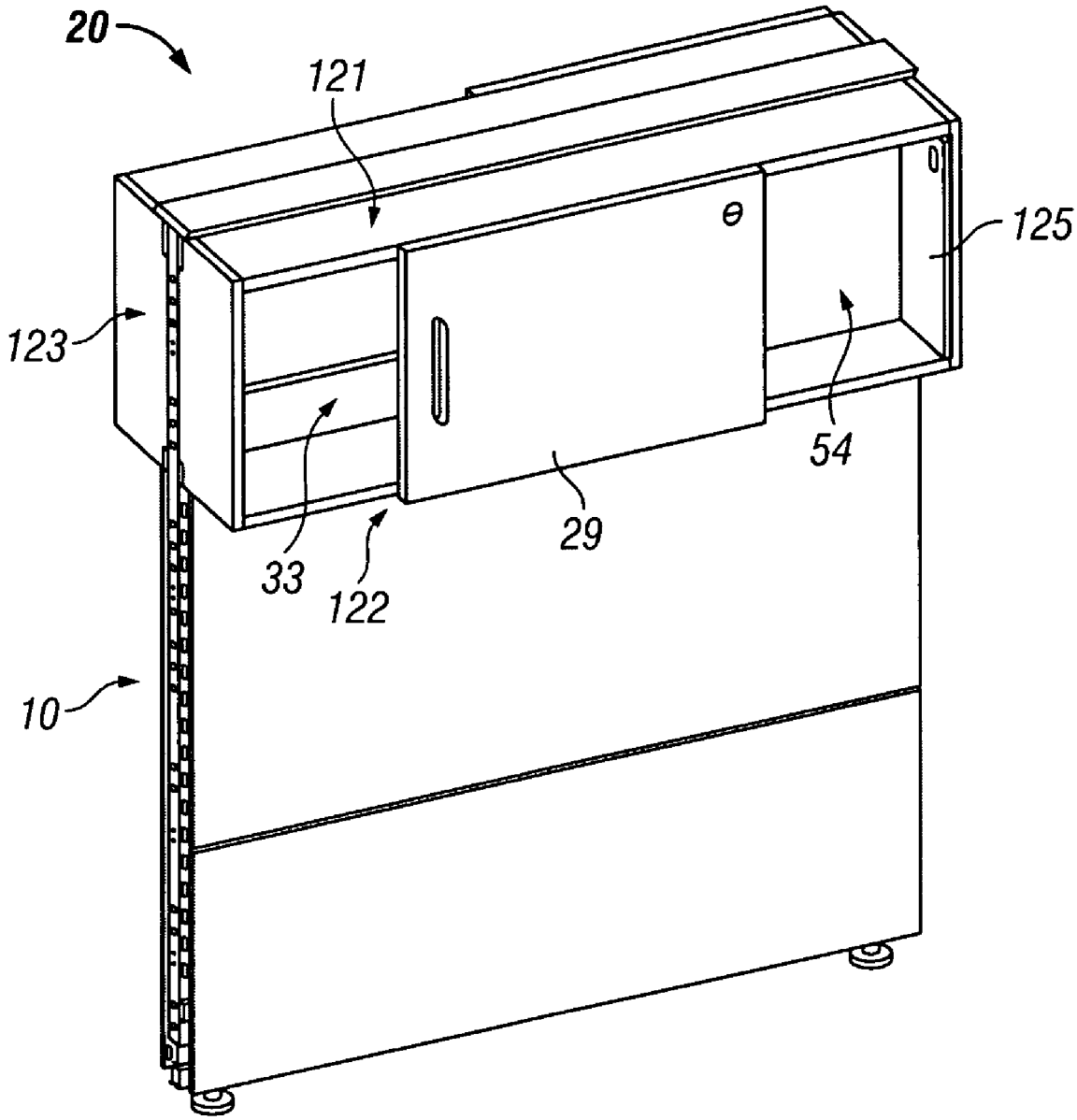
FIG. 15 is a pictorial view similar to that shown in FIG. 7 but of a second embodiment in accordance with the present invention.
Figure 16:
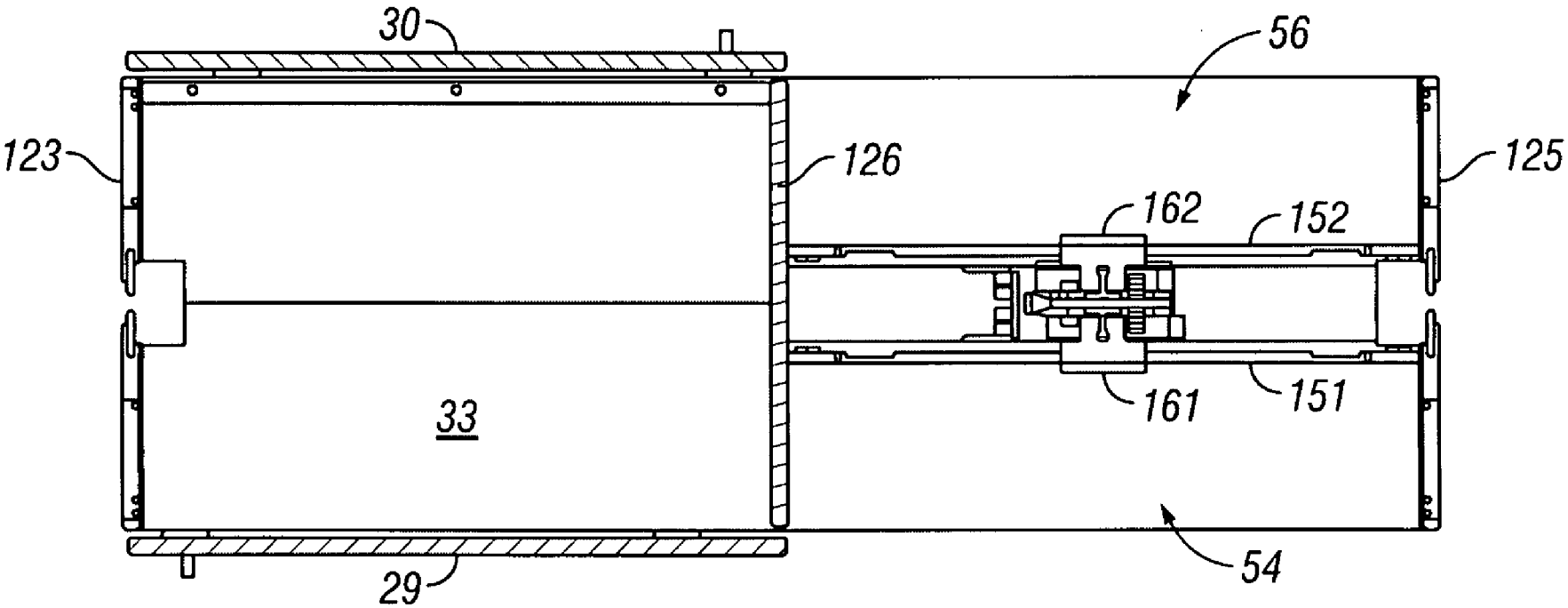
FIG. 16 is a cross-sectional top view similar to that shown in FIG. 11 but of the second embodiment of the invention shown in FIG. 15.

Reference is made to FIGS. 15 and 16 which show a second embodiment of a straddle bin in accordance with the present invention. In the second embodiment, the same reference numerals are used to refer to similar elements to those used with the first embodiment.

The second embodiment may be considered substantially identical to the first embodiment with the exception that merely the first, second and third storage compartments are provided in the second embodiment, that is to eliminate the fourth storage compartment shown in the first embodiment. As best seen in FIG. 15, the first door member 29 operates in an identical manner to that in the first embodiment, that is, movable between the first position in which it overlies the first storage compartment 54 and the second position in which it overlies the third storage compartment 33. The second door member 30 is movable between the first position in which overlies the second storage compartment 56 and the third position as seen in FIG. 15 in which it overlies the first side wall member 28 of the third storage compartment 33.

The preferred embodiments illustrate a particularly preferred arrangement for construction of the straddle bin 20 as with various of the walls such as the top wall 121, and bottom wall 122 comprising a plurality of elements. This is merely preferred and any manner of construction and mounting of the various wall members is within the scope of the present invention. Each wall may comprise a unitary element.

The present invention has been described with doors which are slidable horizontally to various positions to provide access to the electrified, lockable storage compartments. Such sliding doors are preferred however other mounting arrangements for doors such as hinged arrangements may be utilized.

The present invention has been described with reference to preferred embodiments. Many modifications and variations will now occur to a person skilled in the art. For a definition of the invention, reference is made to the following claims.

We claim:

1. A modular office furniture system comprising:

an upright partition having a first side and a second side, the partition comprising a supporting framework formed of vertically spaced horizontal beams and horizontally spaced vertical posts defining at least one rectangular internal opening therebetween through the framework from one side of the framework to the other side, the partition having cladding on both sides of the framework to cover portions of the framework on each side of the partition, a storage element mounted to the framework within the rectangular opening extending to each side beyond the cladding on that side, the storage element having a horizontal top wall, a horizontal bottom wall spaced vertically from the top wall, a vertical first end wall extending between the top wall and the bottom wall at a first end of the storage element and a vertical second end wall extending between the top wall and the bottom wall at a second end of the storage element parallel to the first end wall, a vertical first dividing wall intermediate the first end wall and the second end wall parallel to the first end wall, a vertical second dividing wall intermediate the first dividing wall and the second end wall parallel to the first end wall, a vertical first side wall at the second side of the partition spanning from the first end wall to the first dividing wall between the top wall and the bottom wall, a vertical second side wall at the first side of the partition spanning from the second end wall to the second dividing wall between the top wall and the bottom wall, a vertical first partitioning wall spanning between the first dividing wall and the second dividing wall between the top wall and the bottom wall perpendicular to the first end wall, a vertical second partitioning wall spanning between the first dividing wall and the second dividing wall between the top wall and the bottom wall perpendicular to the first partitioning wall, the second partitioning wall spaced from the first partitioning wall, a cavity defined intermediate the first partitioning wall and the second partitioning wall between the first dividing wall and second dividing wall, a first storage compartment enclosed on five sides by the top wall, bottom wall, first dividing wall, second dividing wall and first partitioning wall and having a first access opening open on the first side of the partition spanning from the first dividing wall to the second dividing wall between the top wall and the bottom wall, a second storage compartment enclosed on five sides by the top wall, bottom wall, first dividing wall, second dividing wall and second partitioning wall and having a second access opening open on the second side of the partition spanning from the first dividing wall to the second dividing wall between the top wall and the bottom wall, a third storage compartment enclosed on five sides by the top wall, bottom wall, first end wall, first dividing wall and first side wall and having a third access opening open on the first side of the partition spanning from the first end wall to the first dividing wall between the top wall and the bottom wall, a fourth storage compartment enclosed on five sides by the top wall, bottom wall, second end wall, second dividing wall and second side wall and having a fourth access opening open on the second side of the partition spanning from the second end wall to the second dividing wall between the top wall and the bottom wall, a first door member on the first side of the partition slidably mounted for linear sliding between a first position in which the first door member overlies the first access opening to close the first access opening and does not cover the third access opening to the third storage compartment and a second position in which the first door member overlies the third access opening to close the third access opening and does not cover the first access opening to the first storage compartment, a second door member on the second side of the partition slidably mounted for linear sliding between a first position in which the second door member overlies the second access opening to close the second access opening and does not cover the fourth access opening to the fourth storage compartment and a second position in which the second door member overlies the fourth access opening to close the fourth access opening and does not cover the second access opening to the second storage compartment, a first electrical outlet provided on the first partitioning wall within the first storage compartment, a second electrical outlet provided on the second partitioning wall within the second compartment, an electrical supply bus located within the cavity and providing electrical power to the first electrical outlet and the second electrical outlet, a first lock to lock the first door in the first position of the first door, and a second lock to lock the second door in the first position of the second door.

2. A modular office furniture system comprising:

an upright partition having a first side and a second side, the partition comprising a supporting framework formed of vertically spaced horizontal beams and horizontally spaced vertical posts defining at least one rectangular internal opening therebetween through the framework from one side of the framework to the other side, the partition having cladding on both sides of the framework to cover portions of the framework on each side of the partition, a storage element mounted to the framework within the rectangular opening extending to each side beyond the cladding on that side, the storage element having:

a horizontal top wall, a horizontal bottom wall spaced vertically from the top wall, a vertical first dividing wall extending between the top wall and the bottom wall, a vertical second dividing wall spaced from the first dividing wall away from the first end wall parallel to the first dividing wall, a vertical first partitioning wall spanning between the first dividing wall and the second dividing wall between the top wall and the bottom wall perpendicular to the first dividing wall, a vertical second partitioning wall spanning between the first dividing wall and the second dividing wall between the top wall and the bottom wall perpendicular to the first partitioning wall, the second partitioning wall spaced from the first partitioning wall, a cavity defined intermediate the first partitioning wall and the second partitioning wall between the first dividing wall and second dividing wall, a first storage compartment enclosed on five sides by the top wall, bottom wall, first dividing wall, second dividing wall and first partitioning wall and having a first access opening open on the first side of the partition spanning from the first dividing wall to the second dividing wall between the top wall and the bottom wall, a second storage compartment enclosed on five sides by the top wall, bottom wall, first dividing wall, second dividing wall and second partitioning wall and having a second access opening open on the second side of the partition spanning from the first dividing wall to the second dividing wall between the top wall and the bottom wall, a first door member on the first side of the partition mounted for movement between a first position in which the first door member overlies the first access opening to close the first access opening and a second position in which the first door member does not cover the first access opening to the first storage compartment, a second door member on the second side of the partition mounted for movement between a first position in which the second door member overlies the second access opening to close the second access opening and a second position in which the second door member does not cover the second access opening to the second storage compartment, a first electrical outlet provided on the first partitioning wall within the first storage compartment, a second electrical outlet provided on the second partitioning wall within the second compartment, an electrical supply bus located within the cavity and providing electrical power to the first electrical outlet and the second electrical outlet, a first lock to lock the first door in the first position of the first door, and a second lock to lock the second door in the first position of the second door.

3. A system as claimed in claim 2 further comprising:

a vertical first end wall extending between the top wall and the bottom wall spaced from the first dividing wall remote from the second dividing wall parallel to the first dividing wall, a vertical first side wall at the second side of the partition spanning from the first end wall to the first dividing wall between the top wall and the bottom wall, a third storage compartment enclosed on five sides by the top wall, bottom wall, first end wall, first dividing wall and first side wall and having a third access opening open on the first side of the partition spanning from the first end wall to the first dividing wall between the top wall and the bottom wall, the first door member slidably mounted on the first side of the partition for linear sliding between the first position in which the first door member overlies the first access opening to close the first access opening and does not cover the third access opening to the third storage compartment and the second position in which the first door member overlies the third access opening to close the third access opening and does not cover the first access opening to the first storage compartment, the second door member slidably mounted for linear sliding between a first position in which the second door member overlies the second access opening to close the second access opening and the second position.

4. A system as claimed in claim 3 in which in the second position the second door member overlies the first side wall and does not cover the second access opening to the second storage compartment.

5. A system as claimed in claim 3 further comprising:

a vertical second end wall extending between the top wall and the bottom wall spaced from the second dividing wall remote from the first dividing wall parallel to the first end wall, a vertical second side wall at the first side of the partition spanning from the second end wall to the second dividing wall between the top wall and the bottom wall, a fourth storage compartment enclosed on five sides by the top wall, bottom wall, second end wall, second dividing wall and second side wall and having a fourth access opening open on the second side of the partition spanning from the second end wall to the second dividing wall between the top wall and the bottom wall, wherein the second door member in the first position does not cover the fourth access opening to the fourth storage compartment and the second door member in the second position overlies the fourth access opening to close the fourth access opening.

6. A system as claimed in claim 1 including a first workstation provided adjacent the first side of the partition, a second workstation provided adjacent the second side of the partition.

7. A system as claimed in claim 1 wherein the first door member in the closed position does not cover any portion of the first access opening and the second door member in the closed position does not cover any portion of the second access opening.

8. A system as claimed in claim 1 wherein the framework includes a plurality of rectangular internal openings defined between the horizontal beams and vertical posts, the cladding comprises cladding panels adapted to span between adjacent of the beams on each side of the framework and at least some of the cladding panels are of the same size, the storage element occupying a rectangular opening sized to be covered by an integral number of the modular cladding panels of the same size.

9. A system as claimed in claim 1 wherein the storage element fills the rectangular space with the top wall and bottom wall each closely adjacent a respective horizontal beam and the first end wall and second end wall each engaging a respective vertical post.

10. A system as claimed in claim 1 wherein one of the first side wall and the second side wall presents directed towards the second side of the partition an element selected from a mirror, a tack board, a whiteboard, a magnetic board and a picture frame.

11. A system as claimed in claim 1 wherein the posts and beams define at least one of a horizontally extending raceway for passage of electrical conduit which extends through the entire width of the partition and a vertically extending raceway which extends through the entire height of the partition, the cavity open to said at least one horizontally extending raceway and vertically extending raceway.

12. A system as claimed in claim 1 including a worktable adjacent one of the first side and second side of the partition, the storage element disposed at a height above the height of the worktable.

13. A system as claimed in claim 1 wherein the first door member is mounted for sliding in linear tracks carried by the top wall member and bottom wall member proximate the first side of the partition.

14. A system as claimed in claim 1 wherein the second door member is mounted for sliding in linear tracks carried by the top wall member and bottom wall member proximate the second side of the partition.

15. A modular office furniture system comprising:

an upright partition having a first side and a second side, the partition comprising a supporting framework formed of vertically spaced horizontal beams and horizontally spaced vertical posts defining at least one rectangular internal opening therebetween through the framework from one side of the framework to the other side, the partition having cladding on both sides of the framework to cover portions of the framework on each side of the partition, a storage element mounted to the framework within the rectangular opening extending to each side beyond the cladding on that side, the storage element having a horizontal top wall, a horizontal bottom wall spaced vertically from the top wall, a vertical first end wall extending between the top wall and the bottom wall at a first end of the storage element and a vertical first dividing wall spaced from the first end wall parallel to the first end wall, a vertical second dividing wall spaced from the first dividing wall away from the first end wall parallel to the first end wall, a vertical first side wall at the second side of the partition spanning from the first end wall to the first dividing wall between the top wall and the bottom wall, a vertical first partitioning wall spanning between the first dividing wall and the second dividing wall between the top wall and the bottom wall perpendicular to the first end wall, a vertical second partitioning wall spanning between the first dividing wall and the second dividing wall between the top wall and the bottom wall perpendicular to the first partitioning wall, the second partitioning wall spaced from the first partitioning wall, a cavity defined intermediate the first partitioning wall and the second partitioning wall between the first dividing wall and second dividing wall, a first storage compartment enclosed on five sides by the top wall, bottom wall, first dividing wall, second dividing wall and first partitioning wall and having a first access opening open on the first side of the partition spanning from the first dividing wall to the second dividing wall between the top wall and the bottom wall, a second storage compartment enclosed on five sides by the top wall, bottom wall, first dividing wall, second dividing wall and second partitioning wall and having a second access opening open on the second side of the partition spanning from the first dividing wall to the second dividing wall between the top wall and the bottom wall, a third storage compartment enclosed on five sides by the top wall, bottom wall, first end wall, first dividing wall and first side wall and having a third access opening open on the first side of the partition spanning from the first end wall to the first dividing wall between the top wall and the bottom wall, a first door member on the first side of the partition slidably mounted for linear sliding between a first position in which the first door member overlies the first access opening to close the first access opening and does not cover the third access opening to the third storage compartment and a second position in which the first door member overlies the third access opening to close the third access opening and does not cover the first access opening to the first storage compartment, a second door member on the second side of the partition slidably mounted for linear sliding between a first position in which the second door member overlies the second access opening to close the second access opening and a second position in which the second door member overlies the first side wall and does not cover the second access opening to the second storage compartment, a first electrical outlet provided on the first partitioning wall within the first storage compartment, a second electrical outlet provided on the second partitioning wall within the second compartment, an electrical supply bus located within the cavity and providing electrical power to the first electrical outlet and the second electrical outlet, a first lock to lock the first door in the first position of the first door, and a second lock to lock the second door in the first position of the second door.

* * * * *